US006672314B2

(12) United States Patent
Vayrette

(10) Patent No.: US 6,672,314 B2
(45) Date of Patent: Jan. 6, 2004

(54) APPARATUS AND METHOD FOR APPLYING A PRODUCT TO HAIR OR SCALP

(75) Inventor: Sophie Hélène Vayrette, Courbevoie (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 09/892,757

(22) Filed: Jun. 28, 2001

(65) Prior Publication Data

US 2002/0020421 A1 Feb. 21, 2002

(30) Foreign Application Priority Data

Jun. 28, 2000 (FR) ..... 00 08306

(51) Int. Cl.[7] ..... A45D 24/22; A45D 24/16

(52) U.S. Cl. ..... 132/114; 132/111; 132/112; 132/113

(58) Field of Search ..... 132/112, 114, 132/115, 116, 207, 208, 212, 120, 313; 401/190, 290, 272, 289; 222/192, 402.1

(56) References Cited

U.S. PATENT DOCUMENTS

| | | | | |
|---|---|---|---|---|
| 2,624,348 A | | 1/1953 | Matson | |
| 2,939,615 A | | 6/1960 | Lerner | |
| 5,018,894 A | | 5/1991 | Goncalves | |
| 5,054,504 A | | 10/1991 | Winrow | |
| 5,567,073 A | | 10/1996 | de Laforcade et al. | |
| 5,937,865 A | | 8/1999 | Dhaliwal | |
| 6,000,405 A | * | 12/1999 | De Laforcade | 132/116 |
| 6,009,881 A | * | 1/2000 | Baudin et al. | 132/112 |
| 6,050,271 A | * | 4/2000 | Spencer | 132/112 |
| 6,145,513 A | * | 11/2000 | Chu et al. | 132/112 |
| 6,334,449 B1 | * | 1/2002 | Burrowes et al. | 132/114 |

FOREIGN PATENT DOCUMENTS

| | | |
|---|---|---|
| EP | 0 943 260 | 9/1999 |
| FR | 2 647 034 | 11/1990 |
| FR | 2 713 060 | 6/1995 |
| WO | WO 98/01053 | 1/1998 |

OTHER PUBLICATIONS

English language Derwent Abstract of EP 0 943 260, Sep. 22, 1999.

Abstract of DE–GM–69 01 735, dated Jan. 17, 1969.

* cited by examiner

*Primary Examiner*—John J. Wilson
*Assistant Examiner*—Robyn Kien Doan
(74) *Attorney, Agent, or Firm*—Finnegan, Henderson, Farabow, Garrett & Dunner, LLP

(57) ABSTRACT

An applicator for applying a product to at least one of hair and a scalp is provided. The applicator may comprise a body configured to be associated with a reservoir, a base and at least two application teeth extending from the base. Each of the application teeth may comprise a free end including a dispensing orifice and a conveying duct. The teeth may have a first end at the dispensing orifice and a second end intended to be placed in flow communication with the reservoir. An elastically deformable coupling may be provided between the base and the body, the elastically deformable coupling may be configured to allow relative movement of the base with respect to the body in response to at least one of axial force applied to at least one of the teeth, and lateral force applied to at least one of the teeth. The applicator may be used to apply a product the hair or scalp. This applicator may be used to apply hair dye, for example.

70 Claims, 4 Drawing Sheets

APPARATUS AND METHOD FOR APPLYING A PRODUCT TO HAIR OR SCALP

The invention relates to an apparatus and method for applying a product to the hair or to the scalp. For example, the invention may be used as an apparatus and method for applying a hair dye to the hair or a treatment product to the scalp.

The applicator at which the present invention is aimed is of the type having at least two applicator tips in the form of hollow teeth, through which there passes a product supply duct extending to a dispensing orifice. This dispensing orifice may be supplied with product from a product reservoir associated with this applicator.

Devices comprising a number of protrusions, aligned in a straight or curved line are known, particularly in the area of hair treatment, such as the area of hair dyeing.

Devices of this type are described, for example, in U.S. Pat. No. 2,624,348, U.S. Pat. No. 5,054,504 and WO-A-98/01 053. These known devices have a number of protrusions aligned on an elongate base and supplied with a liquid product contained in an enclosure. The free ends of these protrusions form dispensing holes arranged in a row, in the manner of a comb. The elongate base, together with the protrusions secured to it, are made of a rigid material.

Elsewhere, DE-GM-69 01 735 discloses a device allowing a product to be dispensed and massaged into the scalp. This device comprises a rigid sole, on which are implanted a number of protrusions arranged in several rows on the surface of the sole, in the manner of a brush. The free ends of the protrusions define a plane. The rigid sole forms part of a product enclosure which has an elastically deformable portion. When product is applied, pressure is exerted on the elastically deformable portion of the enclosure to cause the product to be expelled through the dispensing hole of the protrusions.

EP 0 943 260 describes a device on which fingers are mounted via a base common to the fingers. The fingers have outlet openings through which the preparation emerges to arrive on the desired part of the hair. The fingers may be made of an elastic material.

The devices described hereinabove have a certain number of major disadvantages. Specifically, it is difficult for a number of protrusions to be correctly positioned with respect to the scalp or the hair, given the morphology of the skull, which may have a variable profile of curvature. Thus, if the user does not take special precautions, the ends of some of the protrusions may rub against the scalp and risk causing irritation, while others of the protrusions may remain distant from the scalp. Such treatment may be felt as being unpleasant, or even annoying, by the user. In addition, the application of the product may not be uniform, because some of the product is applied to the scalp while some more of the product is dispersed some distance away from the scalp into the hair, far from the root or base of the hair.

Such non-uniform application may be particularly undesirable, especially when a hair dye has to be applied to the growing base of previously dyed hair. What happens in this type of application is that only the root of the hair needs to be treated. Such application may be also annoying when only the scalp needs to be treated.

It may be one optional aspect of the present invention to improve, or even make more effective and more pleasant, the treatment of the hair or of the scalp with a product, while at the same time providing variable positioning of the dispensing orifices so that the product can be applied precisely to the desired spot.

Another source, FR-A-2 647 034, discloses a device for applying a liquid product to the skin, comprising a rigid porous applicator dome. This applicator element is mounted on a product enclosure via a flexible region such as a bellows. This arrangement gives the system a certain degree of flexibility of radial pivoting in all directions and ensures that application is particularly comfortable.

The above device is not suited to the applying of a liquid product to (or into) the hair or to the scalp. This is because by using this type of device, the product might not be able to penetrate amongst the hair or be applied to the scalp.

Another source, U.S. Pat. No. 2,939,615, describes a device for a hair treatment product comprising a dispenser mounted on a reservoir. The dispenser comprises an ejection chamber which is flexible by virtue of the presence of a bellows forming a wall of the chamber. The chamber is closed by a flat upper wall equipped with small openings which are in communication with the ejection chamber. Solid elements forming conically-shaped projections are mounted on the upper wall, adjacent to each opening. A groove is made along one of the sides of each conical element, to communicate with the corresponding opening provided on the flat upper wall. When the device is applied to the hair, the product emerges via the openings made in the flat upper wall of the ejection chamber. From that moment, the product is in contact with the hair. Even though some of the product flows along the grooves, namely along the conical elements, the product may experience difficulty in reaching the scalp or the root of the hair because the outlet openings for the product are formed on the flat surface.

The present invention optionally overcomes one or more of the disadvantages exhibited by the devices described above.

Hence, one of the optional subjects of the invention is to provide a unit equipped with an applicator head allowing appropriate and variable positioning of the dispensing orifices, depending on the profile of the skull, while at the same time ensuring very precise application.

Another optional subject includes allowing a large amount of product to be dispensed.

Another optional subject is to have particular flexibility for application, to avoid any attack or irritation of the scalp during treatment.

One aspect of the invention relates to an applicator for applying a product to at least one of hair and a scalp. The applicator may comprise a body configured to be associated with a reservoir, a base, and at least two application teeth extending from the base. Each of the application teeth may comprise a free end including a dispensing orifice and a conveying duct. The teeth may have a first end at the dispensing orifice and a second end intended to be placed in flow communication with the reservoir. The applicator may include an elastically deformable coupling between the base and the body. The elastically deformable coupling may be configured to allow relative movement of the base with respect to the body in response to at least one of axial force applied to at least one of the teeth, and lateral force applied to at least one of the teeth.

According to another aspect, there is provided an application device comprising a reservoir, and an applicator on the reservoir. The applicator may comprise a base and at least two application teeth extending from the base. Each of the application teeth may comprise a free end including a dispensing orifice and a conveying duct having a first end at the dispensing orifice and a second end intended to be placed in flow communication with the reservoir. The teeth may have an elastically deformable coupling provided between the base and the reservoir. The elastically deformable coupling may be configured to allow relative movement of the base with respect to the reservoir in response to at least one of axial force applied to at least one of the teeth, and lateral force applied to at least one of the teeth.

According to yet another aspect, a unit may be provided for applying a product, for example, a liquid product, to the hair or to the scalp. The unit may comprise a reservoir of longitudinal axis, for the product. Provided on the reservoir is an applicator head comprising a base from which extends at least two applicator tips, each of the applicator tips being in the form of a hollow tooth through which passes a conveying duct which opens at a dispensing orifice positioned at the free end of the tooth. The dispensing orifice may optionally be located in the center of the free end. The duct is in communication with the reservoir. An elastically deformable coupling is provided between the base and the reservoir to permit relative movement of the base with respect to the reservoir in response to axial force and/or lateral force exerted on at least one of the tips.

The movement permitted between the base and the reservoir may be a movement both along the axis of the reservoir and, in the manner of a ball joint, in pivoting in any radial direction whatsoever with respect to the axis of the reservoir.

To achieve certain optional advantages, the teeth may be three in number. When this is the case, the teeth are arranged on the base in a triangle, for example, in an isosceles triangle.

The number of teeth may be greater than three, if appropriate, and configured in an appropriate layout.

The elastically deformable coupling may be formed by an annular membrane. This coupling may allow the ends of the teeth to move, either axially or in the manner of a ball joint. This arrangement may allow the dispensing orifices to be oriented as precisely as possible in the desired spot, according to the profile of the skull. This arrangement according to an optional aspect of the invention allows three or even more dispensing teeth to be positioned appropriately.

According to one optional embodiment, the elastically deformable coupling may be produced from a material identical to that of the entire applicator head and may be formed by an annular portion of lesser thickness. The coupling may alternatively be formed by a portion comprising a bellows or a portion comprising at least one annular corrugation.

As yet another optional alternative, the elastically deformable coupling may be formed of an elastomer type material different from the one forming the base and the teeth.

Optionally, the annular membrane may be made of natural or synthetic rubber or of a conventional thermoplastic elastomer.

In general, the deformability of such an elastomeric material results from a bending component which gives the base its ability either to pivot like a ball joint or to move axially or laterally in response to force, and return by elasticity to its initial shape when the force ceases. The flexibility of a material that is appropriate for forming the elastically deformable coupling may be characterized by its modulus of elasticity. Examples of materials for the coupling have a modulus of elasticity of at most about 200 MPa (Young's modulus). The flexibility of the elastically deformable coupling may result from the nature of the material forming the coupling and/or from the configuration of the coupling.

The elastomeric material may be characterized by a Shore A hardness of from about 40 to about 70.

For example, the elastically deformable coupling may be secured to a body having a fastening member, for example in the form of a ring, capable of fastening the applicator head onto the reservoir, for example by screwing, snap fastening or any other appropriate means.

Optionally, the applicator teeth form a single piece with the base which can be obtained by molding of an appropriate material.

When the membrane is made of elastomer, it may be produced by two-shot injection molding in an appropriate mold. For example, the applicator head may be made by injecting a first elastomer material to form the elastically deformable coupling, and a second material, the rigidity of which is greater than the rigidity of the first, to form the base and the fastening means. Optionally, the second material may be chosen from more or less rigid or semi-rigid thermoplastic material such as high-density polyethylene or polypropylene.

Optionally, the elastomer membrane may also be produced by overmolding in an appropriate mold between the base and the fastening member, the base and the body may be produced by injection molding a thermoplastic material equivalent to the second material mentioned above, and connected by bridges of material of the film hinge type. These bridges of material, of small thickness, may then be overmolded with elastomer to form the elastically deformable membrane.

Optionally, the teeth may have a frustoconical shape, with a cross section that decreases in the direction towards the dispensing orifice. This arrangement may allow the teeth to penetrate well amongst the hair.

The teeth may have an overall orientation the axis of which is parallel or divergent with respect to the longitudinal axis of the reservoir. The separation of the axis passing through the teeth diverging from the longitudinal axis of the reservoir, may make it possible to regulate the distance between the dispensing orifices and thus to configure the width of the lines traced in the hair and to determine the total width of the surface to be treated. Optionally, the teeth have more or less identical heights.

According to a particular optional embodiment, the base bearing the teeth is dome shaped.

Optionally, all or some of the applicator teeth may be provided with a coating of flock, encouraging the spreading of the product that is to be applied.

An optional gutter provided around all or some of the teeth, optionally formed of the elastically deformable coupling, may make it possible, as appropriate, to collect surplus product that might run after application.

The reservoir may be optionally elastically deformable, particularly in compression. The reservoir may be shaped so that it can act as a member for grasping. With such an optional embodiment, in a movement along the profile of the scalp or along the hair that is to be treated, the user may hold the unit in one hand, while having the possibility at the same time to meter the product being dispensed by exerting appropriate pressure on the walls of the reservoir.

Optionally, all the dispensing orifices may be brought into contact with a non-planar support, such as the scalp, in a determined and oriented manner, also allowing the product to be applied to a relatively broad area. By virtue of the ability of the base to move in many directions (in axial compression, lateral bending or a combination of these two, in the manner of a ball joint), all the ends of the teeth may simultaneously come into contact with the scalp, or in any case, very close to the latter.

Thus, by virtue of the mobility of the base with the teeth, in the manner of a ball joint, the applicator orifices may be oriented with respect to the surface of the skull, for example, with a three-tooth arrangement with the teeth arranged in a triangle, as described hereinabove.

In addition, it may be possible to ensure gentle contact with the scalp throughout the movement of the unit when applying the product, avoiding the irritations that would result from the use of an applicator of the rigid comb type.

In certain optional embodiments, the elastically deformable coupling may act as a damper in the axial direction of the unit, when the teeth come into contact with the scalp. Furthermore, as the teeth move through the hair, the lines drawn can be drawn gently, with less tugging at the hair, by virtue of the lateral elasticity exhibited by the teeth. Thus, flexible and gentle application to the scalp may be obtained, thus avoiding any aggressiveness towards it. Furthermore, an effect of untangling the hair may also be obtained.

Other optional aspects may include a method of applying a product to at least one of the hair and the scalp. The method may comprise providing the application device described herein, orienting the applicator so that the orifice of the teeth faces generally in the direction of at least one of the hair and scalp, and passing a product through the orifice of each tooth to apply the product to at least one of the hair and the scalp.

Optionally, the method may further comprise squeezing the reservoir to flow product from the reservoir to the orifice.

Additionally, the method may further comprise placing the teeth in contact with at least one of the scalp and the hair and moving the applicator with respect to the scalp and/or hair.

When application is performed using an applicator unit with an arrangement of three teeth configured in a triangle, one tooth may be oriented at the front in the direction of travel, making it possible to draw a main line. The other two teeth which may "follow" make it possible to draw two secondary lines located one on each side of the main line. The distance between the teeth which follow is the factor that determines the width of the area treated.

The applicator unit may be, for example, suitable for applying a product of somewhat fluid consistency, for example to the scalp or to the hair.

By way of examples of products that can be applied using the applicator unit, mention may be made of cosmetic and treatment products, such as dyes for keratinous materials, shampoos, conditioners and setting products, and compositions for treating afflictions of the scalp, such as dandruff or psoriasis, etc.

The accompanying drawings are included to provide a further understanding of aspects of the invention and are incorporated in and constitute a part of this specification. The drawings illustrate embodiments of the invention and, together with the description, serve to explain some of the principles of the invention.

In the drawings.

Reference will now be made in detail to some embodiments of the invention, examples of which are illustrated in the accompanying drawings. Wherever possible, the same reference numbers are used in the drawings and the description to refer to the same or like parts.

Figure 1:
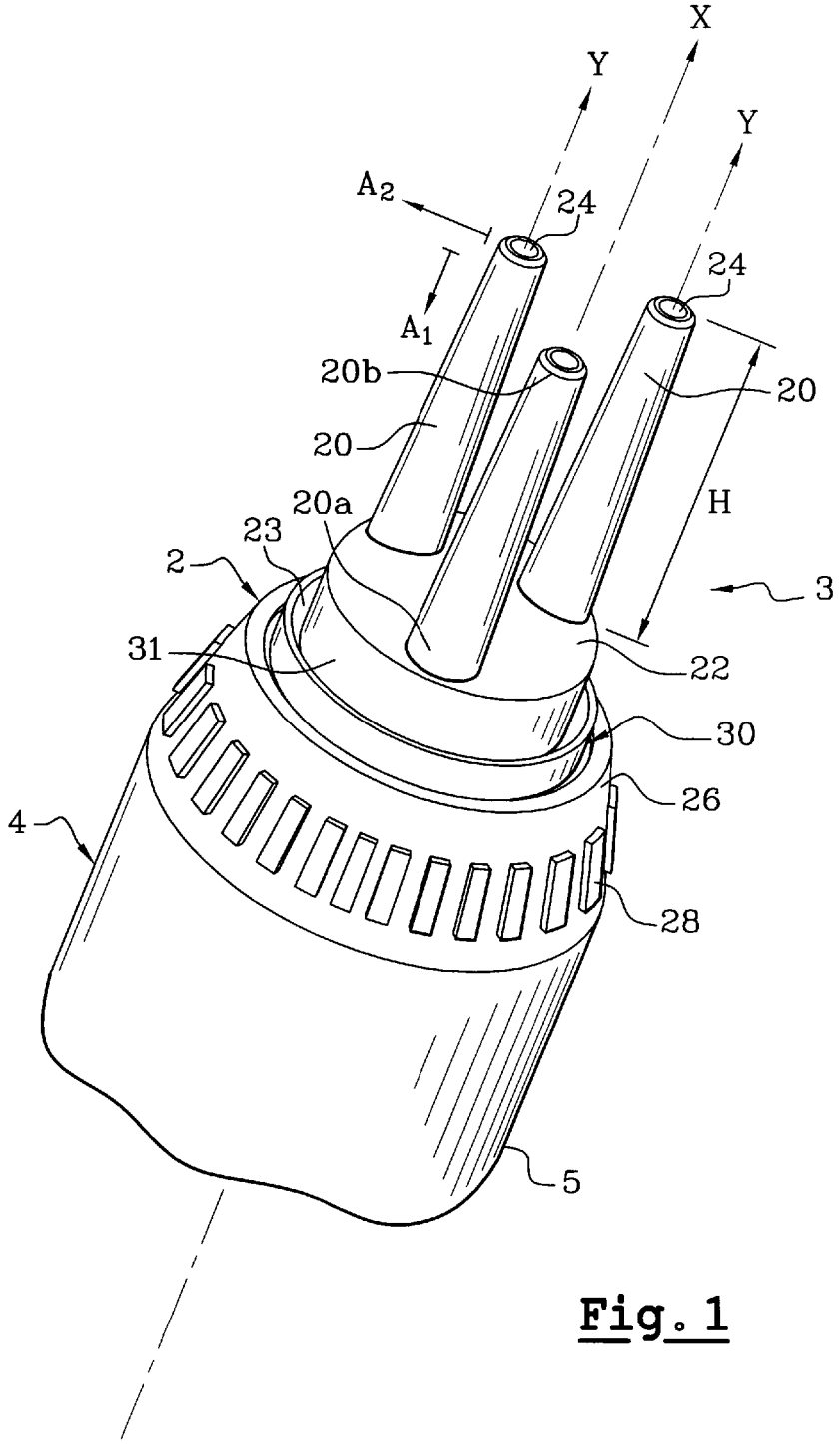
FIG. 1 depicts a partial perspective view of an applicator unit according to the invention.
Figure 2:
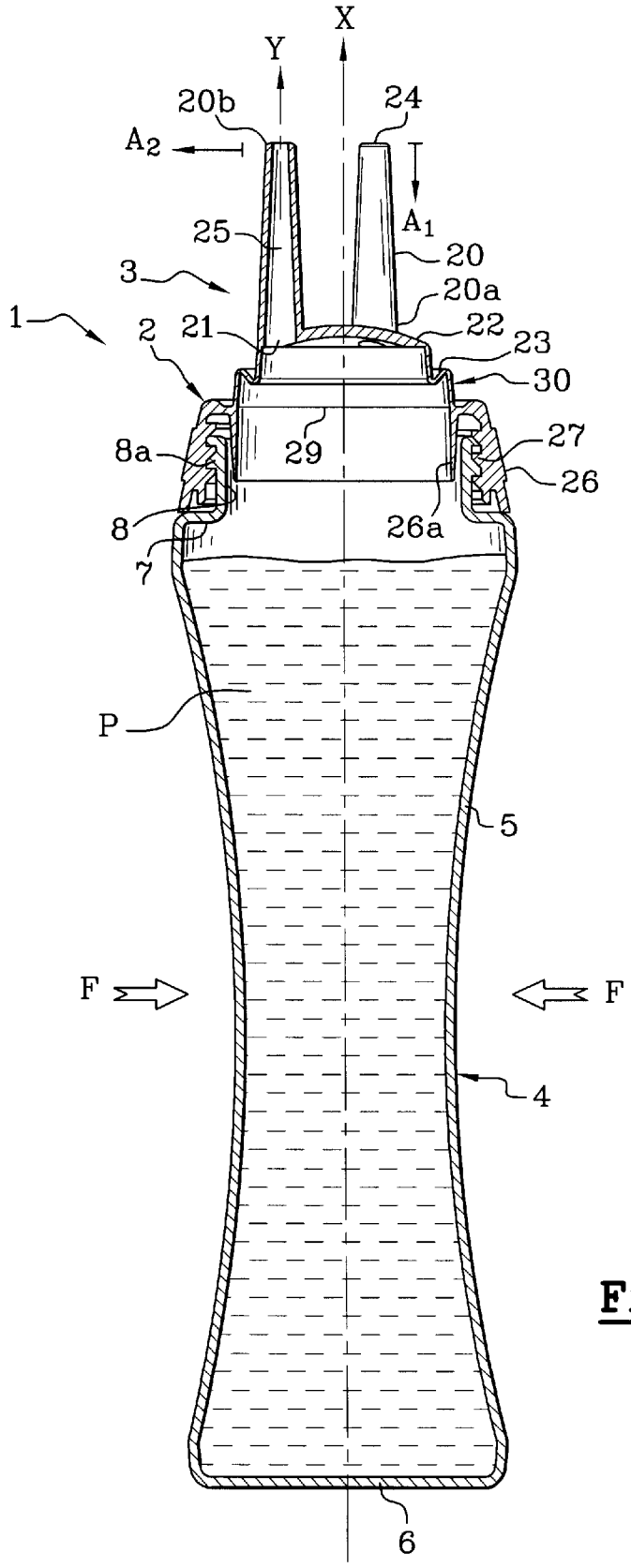
FIG. 2 is a view in axial section of the applicator unit of FIG. 1.

With reference in particular to FIGS. 1 and 2, there can be seen an applicator unit 1 for applying a fluid product P to the hair and/or to the scalp. This unit may be made up of two parts: a reservoir 4 containing the product P and an applicator member 2 for the product. The applicator member 2 may comprise a connecting ring 26 for fastening the applicator member 2 onto the reservoir 4. A body portion of the applicator member 2 and may be comprised of the connecting ring 26 and an optional sealing skirt 26*a*.

The reservoir 4 may include a bottle 5 having a longitudinal axis X and the bottle 5, for example, may have an oval or circular cross section. In one optional embodiment, the reservoir 4 may have a closed end 6. At the opposite end to the closed end 6, the bottle 5 may form a shoulder 7, continuing in the form of a cylindrical neck 8, of a cross section which may be smaller than the largest cross section of the reservoir 5.

The neck 8 may have an external screw thread 8*a*. The reservoir 4 may be shaped in such a way as to allow it to be held easily in the hand. Optionally, during use of the applicator unit 1, the bottle 5 of the reservoir 4 may act as a member for grasping.

Optionally, applicator head 3 may be fastened by screwing onto the neck 8. The applicator head 3 may comprise a connecting ring 26 with an internal screw thread 27 that may complement the external screw thread 8*a* of the neck. The connecting ring 26 may have an external profile 28 that may make it easier for the applicator member 2 to be fitted onto or removed from the reservoir 4.

The optional connecting ring 26 may delimit an interior passage 29. This passage may open onto a first end 21 of a number of conveying ducts 25 made inside each of several associated hollow teeth 20. The conveying ducts 25 may communicate with a dispensing orifice 24 formed at a free second end 20*b* of each tooth 20.

Optionally, the connecting ring 26 may have a sealing skirt 26*a* to allow the applicator member 2 to be fitted in a substantially leaktight manner onto the neck 8 of the reservoir 4.

Optionally, the teeth 20 are borne by a circular base 22, of a shape which is domed outwards.

The teeth 20 may optionally have a frustoconical longitudinal section, having a base portion 20*a*, the cross section of which is greater than the cross section of their free end 20*b*, the base portion 20*a* being secured to the base 22. A peripheral wall 31 may connect to the base 22 and may extend over a short height at right angles to the latter towards the reservoir 4. An elastically deformable annular portion 30 may be connected to the peripheral wall 31. The portion 30, defines an elastically deformable coupling. This annular portion 30 may form a kind of bellows, defining, with the peripheral wall 31, an annular gutter 23, the bottom of which is oriented towards the reservoir 4. This gutter 23 may, after use, collect residual product that might be running along the teeth 20, and then on the base 22.

The annular portion 30 may have a small thickness allowing elastic deformation when axial and/or lateral force is exerted on the free ends 20*b* of the teeth 20.

Of course, the annular portion 30 may be configured differently. Optionally, it may be capable of fulfilling the following functions:

- it may permit an elastic movement of the base and of the applicator teeth, along the axis X, when axial force is exerted simultaneously on the free end of all the teeth;
- it may permit an elastic movement of the base and of the applicator teeth in a pivoting or tilting movement with respect to the axis X, that is to say in the manner of a ball joint, when lateral force is exerted on the free end of at least one of the teeth, and may do so irrespective of the radial orientation of the lateral force allowing all the dispensing orifices 24 to be brought simultaneously as close as possible to the area that is to be treated.

Figure 3:
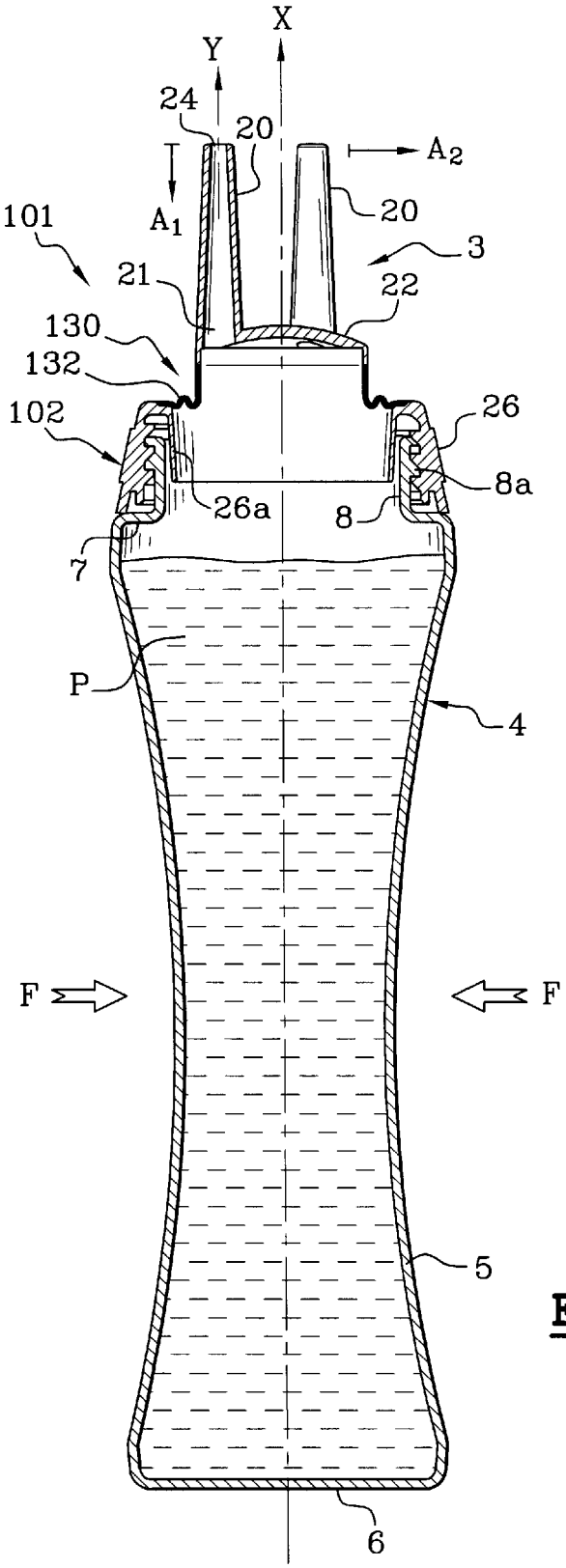
FIG. 3 is a view in axial section of an applicator unit according to another embodiment of the invention.

As visible in FIGS. 1 to 3, the apparent face of the base 22 may have three teeth 20, each extending along an axis Y. At rest, the teeth may be oriented so that each is more or less parallel or divergent with respect to the axis X of the reservoir 4. While a product is being applied, the orientation of the axis Y with respect to the axis X may change, by virtue of the elastic mobility of the teeth. It should be noted that in some optional embodiments the axes Y of the teeth 20 are parallel to one another.

All the teeth 20 may have more or less the same height H. For example, this height H may be about 20 mm, measured between the base portion 20*a* and the free end 20*b*.

Optionally, the free end 20*b* of the teeth 20 may have a dispensing orifice 24. The dispensing orifices 24 may communicate with the reservoir 4 via the conveying ducts 25 formed inside the teeth 20 and passing through the thickness of the base 22 and via the passage 29. Thus, the interior of the reservoir 4 may be in direct communication with each dispensing orifice 24.

All or part of the exterior surface of the teeth 20 may possibly be flocked, as appropriate, allowing the product to spread out better through the hair, particularly when the product is of low viscosity. Because flocking is so well known in the art, it is not shown in the drawings.

In order to apply the product P contained in the reservoir 4 to the hair or with a view to treating the scalp, the user may take hold of the applicator unit 1 by the bottle 5 of the reservoir 4. The user may direct the applicator teeth 20 downwards and place the free ends of the teeth 20 on the scalp, exerting light pressure towards the latter. By virtue of the ball joint effect of the base 22 carrying the teeth 20, the three teeth may be oriented so that their dispensing orifices 24 are very close to the scalp. Optionally, appropriate pressure on the deformable walls of the reservoir bottle 5, may cause an appropriate flow of product P to emerge. By moving the applicator member 2 in the way described earlier over the scalp, while continuing to dispense the product, it is possible thus, in three lines, to treat a region of the hair or of the scalp. This operation may be repeated to treat, as desired, the areas of the hair and/or of the scalp.

According to the optional embodiment of FIG. 3, the applicator unit 101 may differ from the applicator unit 1 in that the elastically deformable coupling 130 may be made of an elastomeric material forming a membrane.

Figure 4:
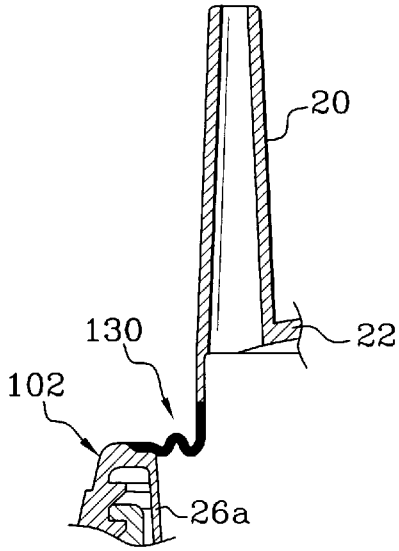
FIG. 4 depicts an enlarged partial view, in axial section, of the unit of FIG. 3.

In FIGS. 3 and 4, parts which are nearly identical to the first embodiment bear the same reference numerals. These parts will be described again only briefly. Parts having a similar configuration and/or function to those of FIGS. 1 and 2 are identified with reference numerals increased by 100 as compared to the parts of FIGS. 1 and 2.

The material of which the elastomer membrane 130 is made may be an elastomeric thermoplastic material which can be deformed particularly in bending and/or in compression. It may be chosen, for example, from known thermoplastic elastomers, for example copolymers of styrene-ethylene-butadiene-styrene (SEBS), of styrene-butadiene-styrene (SBS), blends containing these copolymers or any other thermoplastic elastomer.

Using the two-shot injection molding technique which is well known in the prior art it is possible to produce, in a single mold and in a single piece, the connecting ring 26 from a rigid or semi-rigid material, the membrane 130 from elastomer, and the base 22 with the teeth 20 from a rigid or semirigid material.

Figure 5:
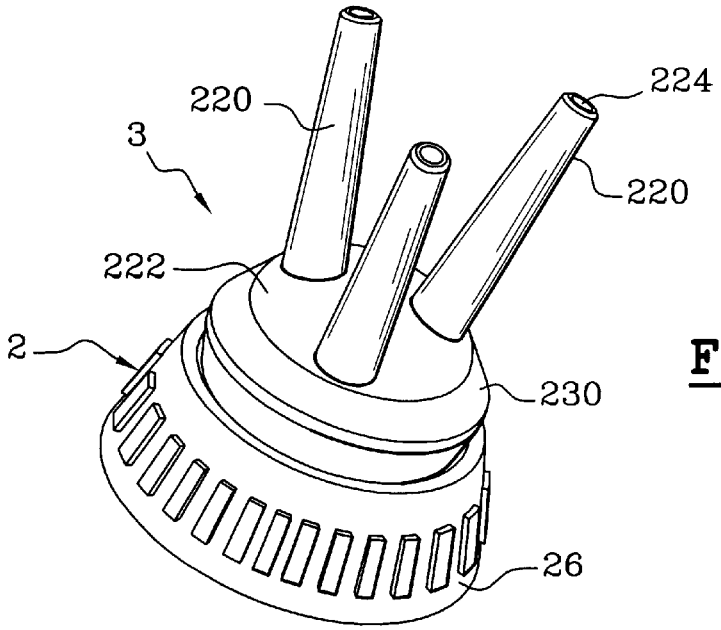
FIGS. 5 and 6 show a perspective view of a dispensing head 3 according to yet another embodiment.
Figure 6:
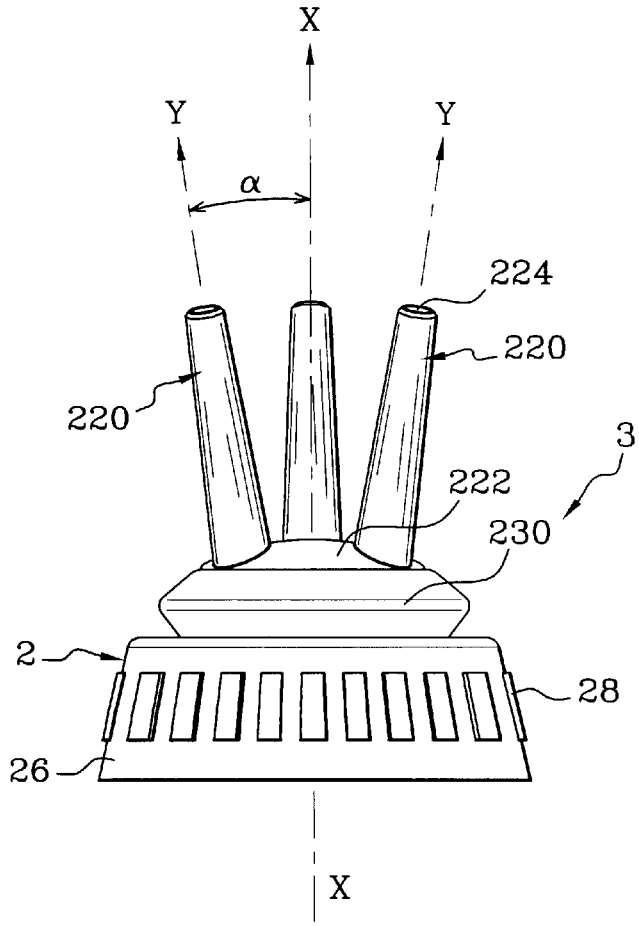

FIGS. 5 and 6 illustrate an applicator head 3 according to another optional embodiment of the invention. In FIGS. 5 and 6, parts which are nearly identical to the first embodiment bear the same reference numerals. These parts will be described again only briefly. Parts having a similar configuration and/or function to those of FIGS. 1 and 2 are identified with reference numerals increased by 200 as compared to with the reference numerals of FIGS. 1 and 2.

According to the optional embodiment in FIGS. 5 and 6, three teeth 220 may be arranged on a domed base 222 so that they diverge with respect to the central axis X of the base. Thus, the axes Y passing through the teeth 220 may form a non-zero angle $\alpha$ with the axis X, optionally an acute angle. Thus, through the choice of the angle $\alpha$ and of the height of the teeth, it may be possible to determine the width of the area to which product is applied when the applicator head is passed through the hair.

The diverging configuration of the teeth 220 can be obtained upon demolding the dispensing head 3. The base 222 may be mounted so that it can move elastically on a coupling ring 26 with the aid of a bellows 230. This bellows may simultaneously allow the applicator head to move along the axis X by axial compression of the bellows, and to move in all directions in the manner of a ball joint, brought about by any lateral pressure on at least one of the teeth. The coupling ring 26, the bellows 230, the base 222 and the teeth 220 may be made of one single plastic material, particularly a rigid or semi-rigid one.

It will be apparent to those skilled in the art that various modifications and variations can be make to the structure and methodology to the present invention. Thus, it should be understood that the invention is not limited to the embodiments and examples discussed in the specification. Rather, the present invention is intended to cover modifications and variations.

What is claimed is:

1. An applicator for applying a product to at least one of hair and a scalp, the applicator comprising:

a body configured to be associated with a reservoir;

a base;

at least two application teeth extending from the base, each of the application teeth comprising a free end defining a tip portion including a dispensing orifice and a conveying duct having a first end at the dispensing orifice and a second end intended to be placed in flow communication with the reservoir; and an elastically deformable coupling provided between the base and the body, the elastically deformable coupling being configured to allow relative movement of the base with respect to the body in response to at least one of axial force applied to at least one of the teeth and lateral force applied to at least one of the teeth.

2. The applicator of claim 1, wherein the orifice is located substantially in the center of the free end.

3. The applicator of claim 1, wherein the body is configured to be attached to the reservoir.

4. The applicator of claim 3, wherein the body comprises internal threading configured to be connected to external threading on the reservoir.

5. The applicator of claim 4, wherein the body further comprises a sealing skirt configured to form a seal with a neck of the reservoir.

6. The applicator of claim 1, wherein the relative movement comprises at least one of a movement along an axis of the reservoir when the reservoir is associated with the body, and a pivoting movement in any radial direction with respect to the axis.

7. The applicator of claim 1, wherein the elastically deformable coupling comprises an annular membrane.

8. The applicator of claim 1, wherein the elastically deformable coupling has a reduced thickness as compared to a thickness of at least one of the body and the base.

9. The applicator of claim 1, wherein the elastically deformable coupling comprises at least one of a bellows and at least one annular corrugation.

10. The applicator of claim 1, wherein the elastically deformable coupling is formed of an elastomeric material.

11. The applicator of claim 10, wherein the elastomeric material has a Shore A hardness ranging from about 40 to about 70.

12. The applicator of claim 10, wherein the elastomeric material has a shore A hardness of ranging from 40 to 70.

13. The applicator of claim 1, wherein the at least two teeth are substantially rigid.

14. The applicator of claim 1, wherein the at least two teeth are molded in one piece with the base.

15. The applicator of claim 1, wherein the applicator is formed of a first material and a second material having a rigidity greater than that of the first material, wherein the first material is elastomeric, wherein the elastically deformable coupling comprises the first material, and wherein the body and the base comprise the second material.

16. The applicator of claim 15, wherein the applicator is formed by one of two-shot injection molding and overmolding.

17. The applicator of claim 1, wherein each of the teeth has a frustoconical shape with a cross section that decreases in a direction toward the dispensing orifice.

18. The applicator of claim 1, wherein the at least two teeth comprise at least three teeth.

19. The applicator of claim 1, wherein the at least two teeth are three teeth arranged on the base in the form of a triangle.

20. The applicator of claim 19, wherein the triangle is an isosceles triangle.

21. The applicator of claim 1, wherein each of the teeth has an axis oriented substantially parallel to an axis of the reservoir when the body is associated with the reservoir.

22. The applicator of claim 1, wherein each of the teeth has an axis diverging from an axis of the reservoir when the body is associated with the reservoir.

23. The applicator of claim 1, wherein the teeth have substantially identical heights.

24. The applicator of claim 1, wherein the base is dome-shaped.

25. The applicator of claim 1, wherein the elastically deformable coupling comprises at least one peripheral wall forming a gutter surrounding at least a portion of the teeth.

26. An application device comprising:

a reservoir; and the applicator of claim 1 provided on the reservoir.

27. The application device of claim 26, further comprising a cosmetic product contained in the reservoir.

28. The applicator device of claim 27, wherein the cosmetic product comprises a hair dye.

29. The application device of claim 26, wherein the reservoir contains at least one of a scalp treatment product and a hair treatment product.

30. The application device of claim 26, wherein the reservoir is shaped in a form configured to be grasped by a single hand.

31. The application device of claim 26, wherein the reservoir comprises at least one elastically deformable wall.

32. The application device of claim 1, further comprising flocking on the at least two teeth.

33. A method of applying a product to at least one of the hair and the scalp, comprising:

providing the application device of claim 26;

orienting the applicator so that the orifice of the teeth faces generally in the direction of at least one of the hair and scalp; and passing a product through the orifice of each tooth to apply the product to at least one of the hair and the scalp.

34. The method of claim 33, further comprising squeezing the reservoir to flow product from the reservoir to the orifice.

35. The method of claim 33, further comprising placing the teeth in contact with at least one of the scalp and the hair.

36. An application device comprising:

a reservoir; and an applicator on the reservoir, the applicator comprising a base, at least two application teeth extending from the base, each of the application teeth comprising a free end including a dispensing orifice and a conveying duct having a first end at the dispensing orifice and a second end intended to be placed in flow communication with the reservoir, and an elastically deformable coupling provided between the base and the reservoir, the elastically deformable coupling being configured to allow relative movement of the base with respect to the reservoir in response to at least one of axial force applied to at least one of the teeth and lateral force applied to at least one of the teeth, wherein the conveying duct is defined by a tooth portion surrounding the conveying duct.

37. The application device of claim 36, wherein the orifice is located substantially in the center of the free end.

38. The application device of claim 36, wherein the applicator further comprises a body attached to the reservoir.

39. The application device of claim 38, wherein the body further comprises internal threading connected to external threading on the reservoir.

40. The application device of claim 39, wherein the body further comprises a sealing skirt forming a seal with a neck of the reservoir.

41. The application device of claim 36, wherein the relative movement comprises at least one of a movement along an axis of the reservoir and a pivoting movement in any radial direction with respect to the axis.

42. The application device of claim 36, wherein the elastically deformable coupling comprises an annular membrane.

43. The application device of claim 38, wherein the elastically deformable coupling has a reduced thickness as compared to a thickness of at least one of the body and the base.

44. The application device of claim 36, wherein the elastically deformable coupling comprises at least one of a bellows and at least one annular corrugation.

45. The application device of claim 36, wherein the elastically deformable coupling is formed of an elastomeric material.

46. The application device of claim 45, wherein the elastomeric material has a Shore A hardness ranging from about 40 to about 70.

47. The application device of claim 45, wherein the elastomeric material has a shore A hardness of ranging from 40 to 70.

48. The application device of claim 36, wherein the at least two teeth are substantially rigid.

49. The application device of claim 36, wherein the at least two teeth are molded in one piece with the base.

50. The application device of claim 38, wherein the application device is formed of a first material and a second material having a rigidity greater than that of the first material, wherein the first material is elastomeric, wherein the elastically deformable coupling comprises the first material, and wherein the body and the base comprise the second material.

51. The application device of claim 50, wherein the application device is formed by one of two-shot injection molding and overmolding.

52. The application device of claim 36, wherein each of the teeth has a frustoconical shape with a cross section that decreases in a direction toward the dispensing orifice.

53. The application device of claim 36, wherein the at least two teeth comprise at least three teeth.

54. The application device of claim 36, wherein the at least two teeth are three teeth arranged on the base in the form of a triangle.

55. The application device of claim 54, wherein the triangle is an isosceles triangle.

56. The application device of claim 36, wherein each of the teeth has an axis oriented substantially parallel to an axis of the reservoir.

57. The application device of claim 36, wherein each of the teeth has an axis diverging from an axis of the reservoir.

58. The application device of claim 36, wherein the teeth have substantially identical heights.

59. The application device of claim 36, wherein the base is dome-shaped.

60. The application device of claim 36, wherein the elastically deformable coupling comprises at least one peripheral wall forming a gutter surrounding at least a portion of the teeth.

61. The application device of claim 36, further comprising a cosmetic product contained in the reservoir.

62. The application device of claim 61, wherein the cosmetic product comprises a hair dye.

63. The application device of claim 36, wherein the reservoir contains at least one of a scalp treatment product and a hair treatment product.

64. The application device of claim 36, wherein the reservoir is shaped in a form configured to be grasped by a single hand.

65. The application device of claim 36, wherein the reservoir comprises at least one elastically deformable wall.

66. The application device of claim 36, further comprising flocking on the at least two teeth.

67. A method of applying a product to at least one of the hair and the scalp, comprising:

providing the application device of claim 36;

orienting the application device so that the orifice of the teeth faces generally in the direction of at least one of the hair and scalp; and passing a product through the orifice of each tooth to apply the product to at least one of the hair and the scalp.

68. The method of claim 67, further comprising squeezing the reservoir to flow product from the reservoir to the orifice.

69. The method of claim 67, further comprising placing the teeth in contact with at least one of the scalp and the hair.

70. An applicator for applying a product to at least one of hair and a scalp, the applicator comprising:

a body configured to be associated with a reservoir;

a base;

at least two application teeth extending from the base, each of the application teeth comprising a free end including a dispensing orifice and a conveying duct having a first end at the dispensing orifice and a second end intended to be placed in flow communication with the reservoir; and an elastically deformable coupling provided between the base and the body, the elastically deformable coupling being configured to allow relative movement of the base with respect to the body in response to at least one of axial force applied to at least one of the teeth and lateral force applied to at least one of the teeth, wherein the dispensing orifice is defined by a tooth portion surrounding the dispensing orifice.

* * * * *

UNITED STATES PATENT AND TRADEMARK OFFICE

CERTIFICATE OF CORRECTION

PATENT NO. : 6,672,314 B2
DATED : January 6, 2004
INVENTOR(S) : Sophie Hélène Vayrette It is certified that error appears in the above-identified patent and that said Letters Patent is hereby corrected as shown below:

Title page,
Item [57], ABSTRACT,
Line 15, "apply a product the hair" should read -- apply a product to the hair --.

Column 9,
Line 15, "shore A hardness of ranging from" should read -- Shore A hardness ranging from --.

Column 10,
Line 64, "shore A hardness of ranging from" should read -- Shore A hardness ranging from --.

Signed and Sealed this

Twenty-fourth Day of February, 2004

JON W. DUDAS
*Acting Director of the United States Patent and Trademark Office*